US006719214B1

(12) United States Patent
Shaffer

(10) Patent No.: US 6,719,214 B1
(45) Date of Patent: Apr. 13, 2004

(54) FIRE-EXTINGUISHING DEVICE

(76) Inventor: Gene P. Shaffer, 5139 Hazeltine Ave., Sherman Oaks, CA (US) 91427

( * ) Notice: Subject to any disclaimer, the term of this patent is extended or adjusted under 35 U.S.C. 154(b) by 0 days.

(21) Appl. No.: 10/410,332

(22) Filed: Apr. 10, 2003

(51) Int. Cl.[7] ..... A62C 15/06

(52) U.S. Cl. ..... 239/271; 239/222.19; 239/311; 169/16

(58) Field of Search ..... 169/45, 16, 46, 169/47; 239/271, 289, 311, 222.19, 261, 264, 381

(56) References Cited

U.S. PATENT DOCUMENTS 4,071,195 A * 1/1978 Kuhns et al. ..... 239/289
4,697,740 A * 10/1987 Ivy ..... 239/271
5,540,284 A * 7/1996 Esposito et al. ..... 169/62
5,947,039 A * 9/1999 Lundgren et al. ..... 111/7.1
6,068,204 A * 5/2000 Alexander ..... 239/310
6,116,524 A * 9/2000 Zapalac ..... 239/548
6,245,252 B1 * 6/2001 Hicks et al. ..... 252/8.05
6,386,293 B1 * 5/2002 Bartlett ..... 169/47
6,588,929 B1 * 7/2003 Dornbush ..... 366/160.2

* cited by examiner

*Primary Examiner*—Gene Mancene
*Assistant Examiner*—Thach H Bui
(74) *Attorney, Agent, or Firm*—Albert O. Cota

(57) ABSTRACT

A fire-extinguishing device (10) that is disclosed in three embodiments. All three embodiments utilize a water-spraying unit (12), a water hose (20) and a water-delivering tube (28). When the device (10) is attached to a pressurized water source (150) a water spray can be directed into a burning area. The first embodiment of the device (10) utilize a triangular water-delivering tube (28) that when attached to an elongated water supply tube (64) functions as a battering ram for penetrating a building structure. The second embodiment consists of an elongated water-delivering tube (28) having a lower section (36) that has attached a support structure (94) that is angled to substantially fit over a gabled roof. The third embodiment is also comprised of an elongated water-delivering tube (28) that is attached to a side of a fire truck (160). When the truck (160) is parked alongside a burning structure a water spray is produced that is directed into a burning area.

17 Claims, 5 Drawing Sheets

FIRE-EXTINGUISHING DEVICE

TECHNICAL FIELD

The invention generally pertains to devices that are utilized to extinguish a fire, and more particularly, to a device that can be inserted into, placed near or upon a burning area to provide a directable spray of water.

BACKGROUND ART

One of the most dangerous and destructive of all the natural forces is fire. Throughout history and to the present day, fire has been responsible for some of earth's most terrible catastrophes. As a result of fire's ability to engulf and quickly destroy many of mans most important necessities, such as structure and food/crops, almost every group of people living together have developed some means of systematically fighting fire. From the lowest aboriginal tribes to the most technologically advanced urban communities, the knowledge and ability to quickly extinguish a fire is of paramount importance.

As technology has progressed there have been improvements to the means and methods of fighting fires. But, regardless of the technology, the basic premise of extinguishing a fire has remained-in order to put out a fire, the fire must be deprived of oxygen or saturated with water. Although there are a small number of fires, typically chemical, that can not be extinguished with water, for the majority of fires water is the preferred means.

Whenever a fire breaks out, whether in a structure such as a residence or commercial building, or in an open area, such as a forest, a group of firefighters respond. By using a large number of methods and tools, the firefighters contain the fire and eventually extinguish it. Unfortunately, there is a significant problem in that when using the preferred method of water to fight a fire, a firefighter must be physically present to direct the water onto the flames. This often requires the firefighters to enter a burning building or to proceed into a forest that is engulfed in flames. Since fire is so unstable and difficult to predict, many firefighters have lost their lives while attempting to extinguish a fire. BY entering a burning location the firefighters are susceptible to the fire itself, as well as deadly fumes and smoke, which can quickly overcome the firemen.

If there was some means by which water could be placed in a location or position to effectively fight a fire, without requiring the placement to be accomplished by a person, the benefits would be very significant. By allowing the firefighters to remain at a safe distance from the fire, while still managing to saturate the flames with water, the inherent risk to the firefighter would greatly diminish.

A search of the prior art did not disclose any patents that read directly on the claims of the instant invention, however the following U.S. patents are considered related:

| Pat. No. | INVENTOR | ISSUED |
|---|---|---|
| 6,113,153 | Yang | 5 Sep. 2000 |
| 4,618,002 | Mears | 21 Oct. 1986 |
| 4,066,129 | Anderson | 3 Jan. 1978 |

The 6,113,153 patent discloses a water spray hose device that includes a water spray hose having connectors at each end of the hose. Each connector consists of a primary connector, a screw collar, and two semicircular splints. At the front of the semicircular splints there are several deflectable elastic walls for gripping the spray hose.

The 4,618,002 patent discloses a fire protection sprinkler head that includes a latch for retaining a valve closure in a standby position until a thermally responsive element releases the latch at a preset temperature. The released latch then allows the flow of a fire-retarding fluid. The sprinkler also includes a deflector that is released by the latch, which then forces a spring detent radially outward into engagement with the catch to secure the latch in the standby position.

The 4,066,129 patent discloses a sprinkler flange attached to a bracket on the sprinkler body when used with recessed sprinklers, a cover plate can be attached to the flange with a bonding material. By means of a boss and should joints the flange and the attached cover plate can be easily mounted on the sprinkler and can be easily removed for inspection and/or servicing of the sprinkler.

For background purposes and as indicative of the art to which the invention is related reference may be made to the remaining cited patents.

| Pat. No. | INVENTOR | ISSUED |
|---|---|---|
| 6,129,153 | Young | 10 Oct. 2000 |
| 5,094,298 | Polan | 10 Mar. 1992 |
| 4,909,443 | Takagi | 20 Mar. 1990 |
| 4,785,998 | Takagi | 22 Nov. 1988 |
| 4,715,447 | Johnson | 29 Dec. 1987 |

DISCLOSURE OF THE INVENTION

The fire-extinguishing device described herein is designed to expedite the extinguishing of structural fires, open-air fires and forest fires. The device is disclosed in three embodiments with all the embodiments utilizing the following basic elements:

a) at least one water-spraying unit having a lower male coupler and an upper water-dispersing orifice, b) a water hose having a front female coupler and a rear water-source coupler, c) a water-delivering tube having:

(1) a closed front end, (2) a rear end having a male coupler dimensioned to be coupled to the front female coupler on the water hose, and (3) a lower section, and an upper section having at least one threaded port dimensioned to receive the lower male coupler of the water-spraying unit. When the water hose is attached to the water-delivering tube and the rear water-source coupler on the hose is connected to a pressurized water source, the water-spraying unit produces a water spray that can be directed into a burning area.

The water-spraying unit is angled upward at a preferred angle of 45° and can be adjusted to direct the water spray over a 360° circular pattern.

The water-delivering tube, which can have attached a plurality of water spraying units, is disclosed in three design configurations, a triangular water-delivering tube, a first elongated water-delivering tube and a second elongated water-delivering tube.

The triangular water-delivering tube is designed to function as a battering ram that is used to Penetrate-a door, window or a wall of a burning structure before the water pressure is turned on. In this design the water-delivering tube is connected to an elongated water supply tube that is used to better guide and control the forward motion of the triangular tube. The elongated hollow tube can also be placed on top of a stabilizing platform that provides balance and additional control when the triangular water-delivering tube is being pushed forward.

The first elongated water-delivering tube includes a pair of support structures having outward ends that terminate with a longitudinal support rod. The support structures are specifically angled to fit upon the apex of a gabled roof. Provisions are also provided to allow two of the first elongated water-delivering tubes to be connected in series by means of a hose having a third, centrally located water coupler that is connected to a pressurized water source.

The second elongated water-delivering tube is specifically designed with bracketing to allow the tube to be attached to the side or an upper structure of a fire truck having a source of or access to a source of pressurized water. In this design, the fire truck would be parked adjacent or near a burning area and the water flow would be directed into the fire.

In view of the above disclosure, the primary object of the invention is to provide a fire extinguishing device that can be remotely placed in close proximity to a fire without endangering firefighters.

In addition to the primary object of the invention it is also an object of the invention to provide a fire extinguishing device that:

- can expedite the extinguishing of structural fires and thereby save lives and property,
- is easy to operate,
- can be made in various lengths and diameters to accommodate various types of fire,
- is reliable and virtually maintenance free,
- is cost effective from both a consumer's and manufacturer's points of view.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 11 is a side elevational view showing an elongated water-delivering tube cradled by a J-bracket that is attached to a side of a fire truck.

BEST MODE FOR CARRYING OUT THE INVENTION

Figure 1:
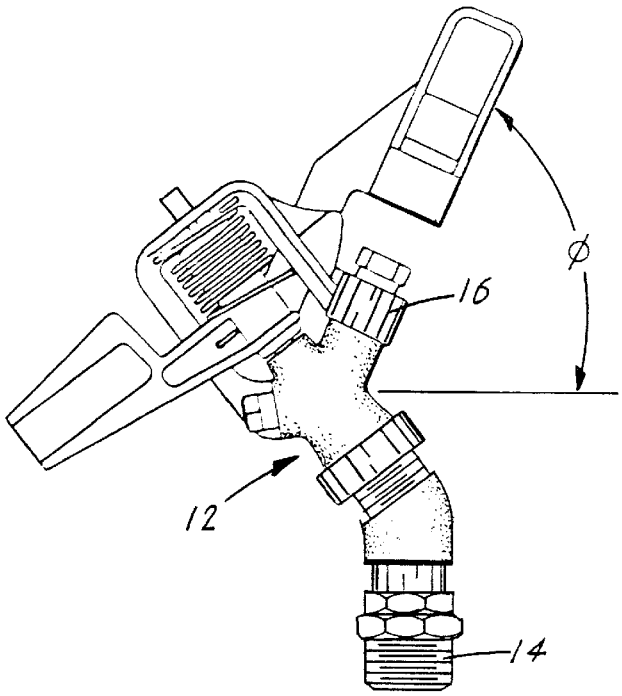
FIG. 1 is a front elevational view of a water-spraying unit as used with the fire extinguishing device.

The best mode for carrying out the invention is presented in terms of three embodiments for a fire-extinguishing device 10 that can be utilized to extinguish structural fires as well as open-air or forest fires. All three embodiments, as shown in FIGS. 1–14, are designed to quickly, easily, effectively and safely extinguish a fire. While each of the embodiments has a unique application, the principle and basic functionality of all three embodiments is identical. As a result of this, all three embodiments of the fire-extinguished device 10, (hereinafter "FED 10") utilize the following major elements: at least one water-spraying unit 12, a water hose 20, and a water-delivering tube 28. Additionally, all three embodiments utilize a pressurized water source 150, and the third embodiment also utilizes a fire truck 160 having a source of pressurized water.

As shown best in FIG. 1, the water-spraying unit 12 can be specifically designed or it can consist of a modified water spraying unit 12 that can be modified from a standard water-spray unit manufactured by the Buckner By Storm Corporation located in California. The modification consists of having an angled water-dispersing orifice 16 that replaces the standard, vertical water-dispersing orifice. In either design, the unit 12 includes a lower male coupler 14 and an angled water-dispersing orifice 16. As shown in FIG. 1, the angle ø of the water-dispersing orifice 16 can range from 10° to 80° and has means for selectively directing the water spray over a 360° circular pattern.

Figure 2:
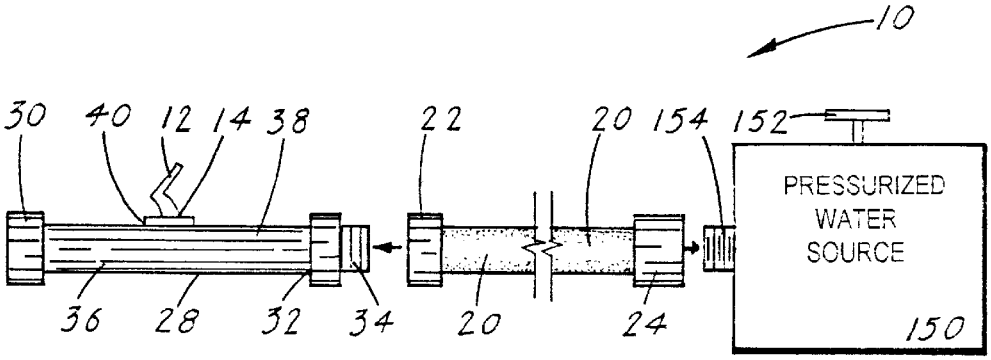
FIG. 2 is an assembly diagram of a basic, generic design for the fire extinguishing device.

The basic, generic design of the FED 10, as shown in FIG. 2, includes the water spraying unit 12, the water hose 20, the water-delivering tube 28 and the pressurized water source 150.

The water hose 20 has a front female coupler 22 and a rear water-source coupler 24. The hollow water-delivering tube 28 is comprised of a closed front end 30, a rear end 32 that has a male coupler 34 dimensioned to be coupled to the front female coupler 20 on the water hose 20, a lower section 36, and an upper section 38. As shown in FIG. 2, at least one threaded port 40 is located substantially at the center of the upper section 38 of the water-delivering tube 28. The port 40 is dimensioned to receive the lower male coupler 14 of the water-spraying unit 12.

When the female coupler 22 on water hose 20 is attached to the male coupler 34 on the water-delivering tube 28, the water source coupler 24 is connected to a water connector 154, the pressurized water source 150, and the water valve 152 is turned on, the water-spraying unit 12 produces a water spray that can be directed into a burning area.

Figure 3:
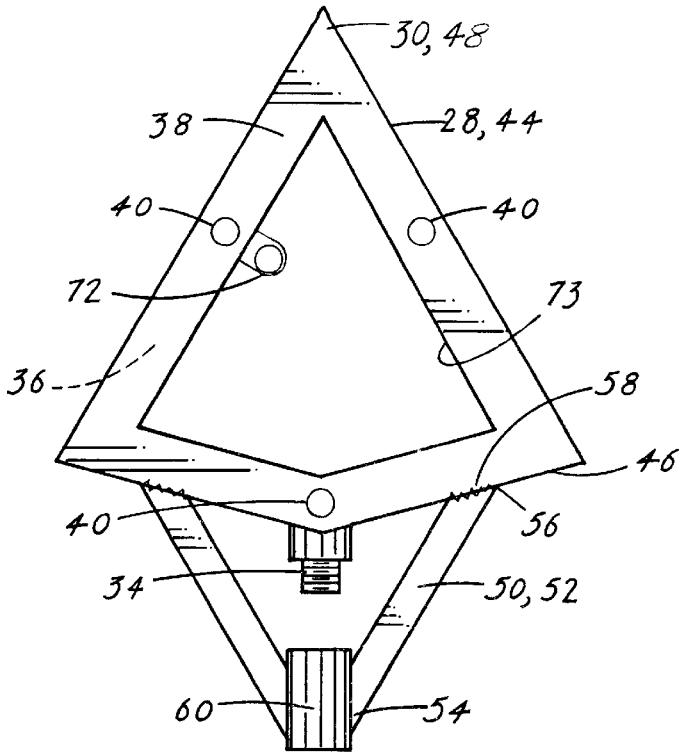
FIG. 3 is a top plan view of a triangular water-delivering tube.
Figure 14:
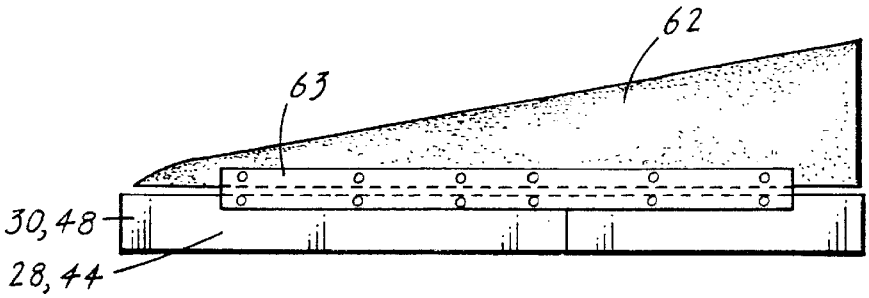
FIG. 14 is a side elevational view showing a protective shroud attached by means of a hinge to a side of the triangular water-delivering tube.
Figure 4:
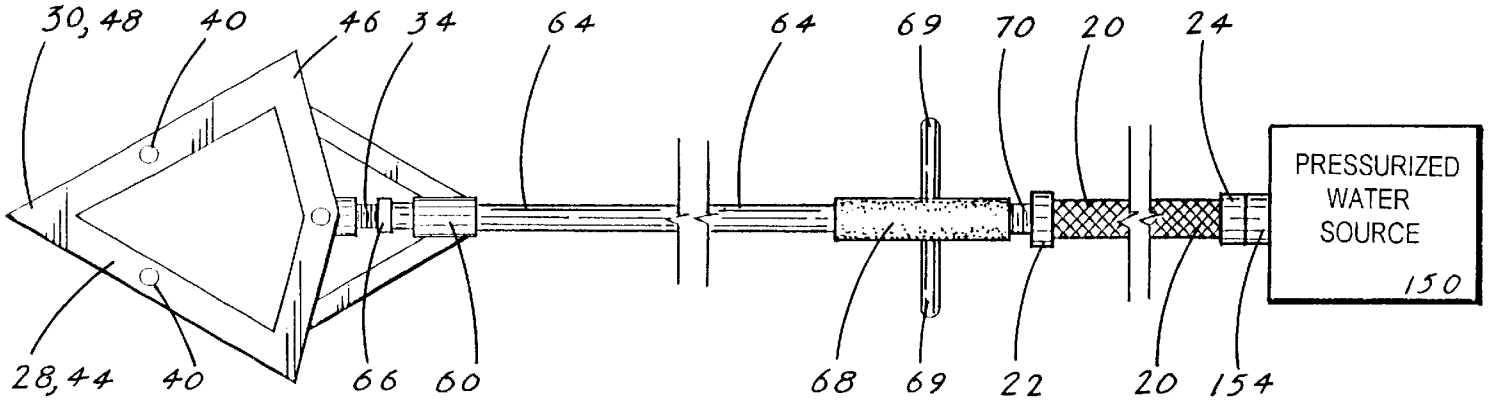
FIG. 4 is a top plan view showing a triangular water delivering tube attached sequentially to an elongated water supply tube and a water hose connected to a pressurized water source.

In the first embodiment of the FED 10, as shown in FIGS. 3, 4 and 14, the tube 28 is comprised of a triangular water-delivering tube 28 having a rear section 46 and a closed front end 30 consisting of a pointed front end 48. The pointed front end 48 can function as a battering ram for penetrating a building structure, such as a window or a door, prior to turning the water on. The first embodiment further comprises an outward-extending structure 50 that consists of a pair of legs 52 having rear ends 54 and front ends 56. The front ends 56 are attached by an attachment means 58 such as welding to the rear section 46 of the triangular water-delivering tube 28. The rear ends 54 of the legs 52 angularly terminate at a cylindrical opening 60 that is in alignment with a male coupler 34 that extends from the rear section 46 of the triangular water-delivering tube 28, as best shown in FIG. 3.

Figure 6:
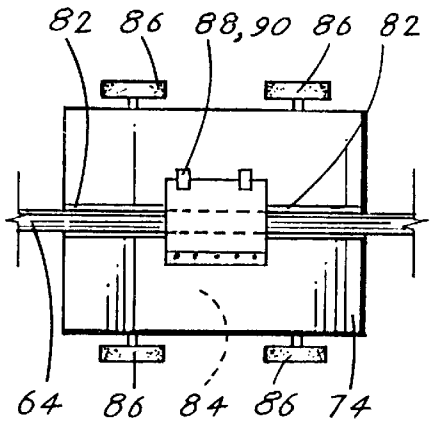
FIG. 6 is a top plan view showing the elongated water supply tube of FIG. 4 resting upon a groove located on the upper surface of a pole stabilizing platform that includes a pole clamp and a set of wheels.
Figure 5:
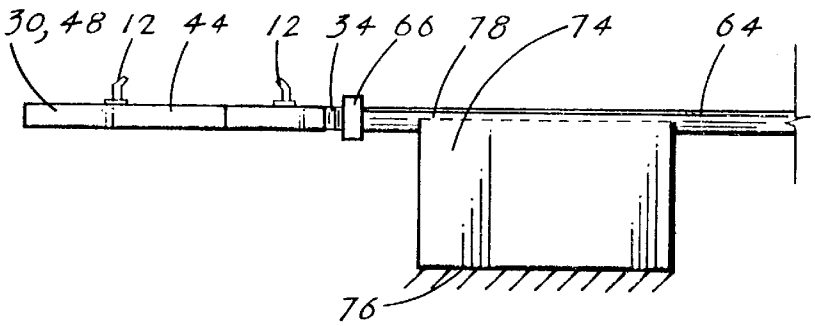
FIG. 5 is a side elevational view showing the elongated water supply tube of FIG. 4 resting upon a groove located on the upper surface of a pole stabilizing platform.

The first embodiment of the FED 10 can also function with an elongated water supply tube 64, as shown in FIG. 4, and an elongated tube stabilizing platform 74, as shown in FIGS. 5 and 6.

The elongated water supply tube 64 includes a front female coupler 66 and a rearward hand-gripping section 68 that terminates in a male coupler 70 that is attached to the front female coupler 22 on the water hose 20. The tube 64 includes a pair of lateral handles 69 and is dimensioned to slidably fit through the cylindrical opening 60 on the triangular water-delivering tube 44 and have the front female coupler 66 attached to the male coupler 34 on the rear section 46 of the triangular water-delivering tube 28.

The elongated pole stabilizing platform 74, as shown in FIG. 5, includes a lower surface 76 and an upper grooved surface 78 that is dimensioned to slidably support and stabilize the elongated water supply tube 64. The platform 74 allows the elongated water supply tube 64 to travel along the grooved surface 78 when the triangular water-delivering tube 28 is moved forward into a burning building structure. Additionally, as shown in FIG. 6, the elongated pole stabilizing platform 74 can also be designed with an upper grooved surface 82 and a lower surface 84. The lower surface 84 can include a set of four wheels 86 or three wheels with the rear wheel consisting of a swivel wheel (not shown), and means 88 for securing the elongated water supply tube 64 to the grooved surface 82, such as a clamp 90, as also shown in FIG. 6. This second design of the stabilizing platform 74 allows the secured elongated hollow pole 64 to move the triangular water-delivering tube 28 forward into a burning structure.

The triangular water-delivering tube 28 can also be designed to include a protective shroud 62 that is attached to a side of the tube 28 by a hinge 63 as shown in FIG. 14. The hinged shroud 62 is designed to protect the water-dispersing units 12 when a battering is in progress. At the completion of a battering the firefighter rotates the attached elongated water supply tube 64 by means of the lateral handles 69, to cause the shroud 62 to rotate and to fall to the side of the tube 28. After the shroud 62 falls, the water-spraying units 12 are exposed.

The triangular water-delivering tube 28 can be designed with a plurality of water-spraying units 12 that extend upward from the upper section 38, as shown in FIG. 3. Alternatively, as also shown in FIG. 3, a 90° elbow can be attached to a side surface 73 of the tube 28 to reduce the vertical height of the water-spraying units 12. This reduction in height allows the upward angle of the shroud 62 to be reduced.

Figure 8:
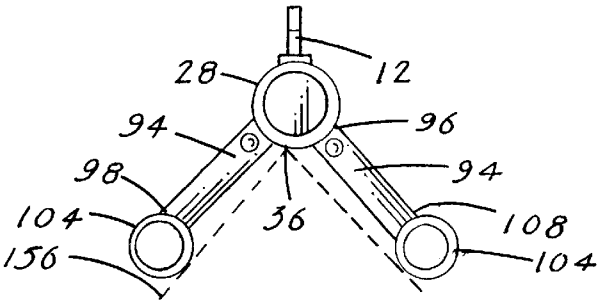
FIG. 8 is a front elevational view of the water-delivering tube shown in FIG. 7.
Figure 7:
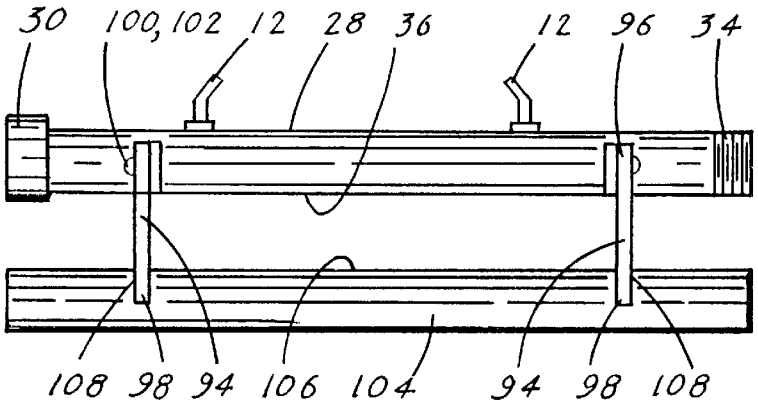
FIG. 7 is a side elevational view of an elongated water-delivering tube having a pair of angled support structures.
Figure 9:
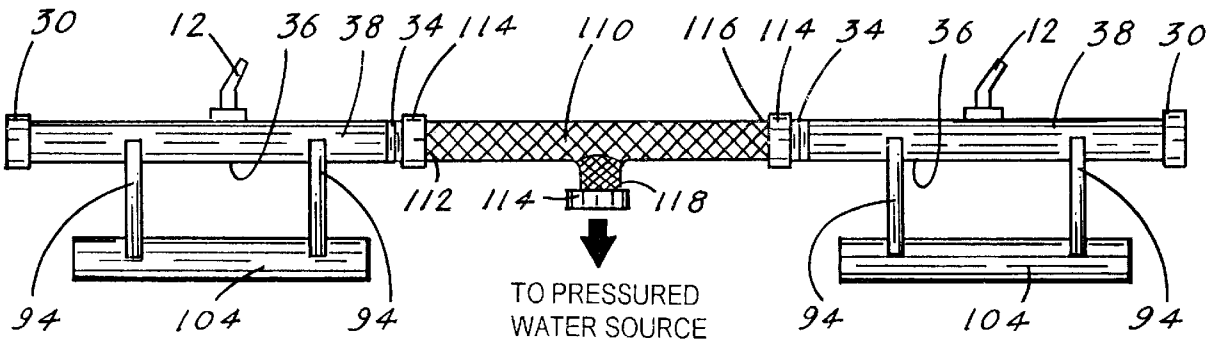
FIG. 9 is a side elevational view showing two elongated tubes with two angled support structures connected in series by means of a coupling hose.

The second embodiment of the FED 10, as shown in FIGS. 7, 8 and 9, is comprised of an elongated water-delivering tube 28 having a lower section 36, an upper section 38, a closed front end 30 and a rear end 32 having attached a male coupler 34. At least one water dispersing unit 12 is located on the upper section 38. The lower section 36 of the water-delivering tube 28 has attached a pair of support structures 94. As shown in FIGS. 7 and 8, either the support structure 94 are outwardly angled, as shown best in FIG. 8, to provide a stable platform for a flat roof or to substantially fit upon the apex of a gabled roof 156, as shown by the broken lines in FIG. 8. Each of the support structures 94 has an upper end 96 and a lower end 98. The upper end 96 is attached to the lower half 36 of the water-delivering tube 28 by an attachment means 100 such as a bracket and bolt combination 102. The second embodiment of the FED 10 can also include a pair of hollow or solid longitudinal support rods 104, with each having an upper surface 106 to which is attached, by an attachment means 108 such as welding, the lower end 98 of the support structures 94, as shown in FIGS. 7 and 8.

As shown in FIG. 9, the second embodiment of the FED 10 can also be designed to utilize a coupling hose 110 having a first end 112 that terminates in a female coupler 114, a second end 116 that terminates in a female coupler 114, and a third end 118 that terminates in a female coupler 114 that is connected to a pressurized water source 150. The two female couplers 114 attached to the first and second ends 112, 116 are designed to be attached to a male coupler 34 on the elongated water-delivering tube 28. The coupling hose 110 allows at least two of the elongated water-delivering tubes 28 to be connected in series, as shown in FIG. 9. Additionally, in lieu of the coupling hose 110, a rigid coupling tube (not shown), can be employed. The coupling tube also has a first end 112 that terminates in a female coupler 114, a second end 116 that terminates in a female coupler 114, and a third end 118 that also terminates in a female coupler 114. The coupling tube can also be utilized to connect at least two of the elongated water-delivering tubes 28 in series.

Figure 10:
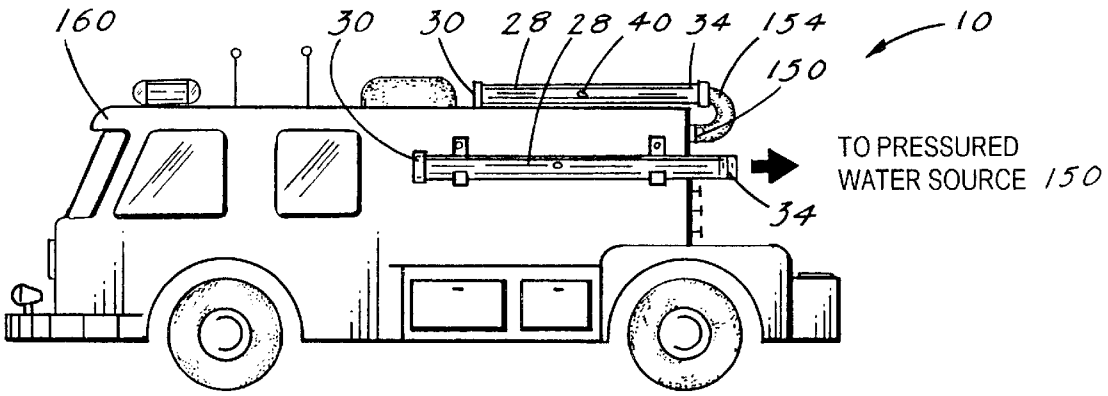
FIG. 10 is a side elevational view showing an elongated water-delivering tube attached to a side and an upper structure of a fire truck.
Figure 11:
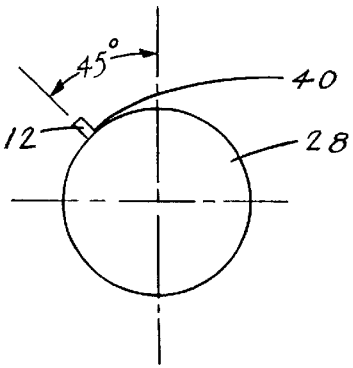
FIG. 11 is a front elevational view showing a water spraying unit located at 45°. This design is utilized when the elongated water-delivering tube is attached to a fire truck.

The third embodiment of the FED 10, as shown in FIGS. 10, 11, 12 and 13, is comprised of an elongated water-delivering tube 28 that is designed to be used in combination with a fire truck 160, as shown in FIG. 10. In this third embodiment, as shown in FIG. 11, at least one threaded port 40 is located on the upper section 38 of the water-delivering tube 28, at a distance substantially midway between the top of the tube's upper section 38 and the beginning of the tube's lower section 36. With this arrangement, the threaded port 40 allows a water-spraying unit 12 to be located at a preferred 45° water spray angle. Three methods are disclosed for attaching the water-delivering tube 28 to the fire truck 160.

Figure 12:
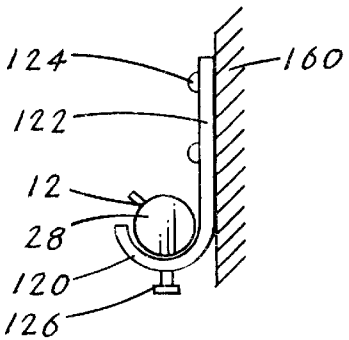

In the first attachment method, as shown in FIG. 12, the water-delivering tube 28 is cradled by at least two J-brackets 120. Each bracket 120 includes a tube-securing bolt 126 and a vertical section 122 that is permanently attached by an attachment means 124 such as bolts, to a side of the fire truck 160, as shown in FIG. 10, when the fire truck 160 is parked alongside a burning structure, and the water-delivering tube 28 is connected to the fire truck's pressurized water source 150, a water spray is produced that can be directed into a selected area of the structure.

Figure 13:
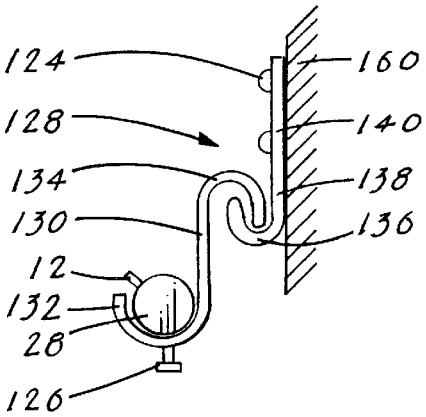
FIG. 13 is a side elevational view showing an elongated water-delivering tube cradled by a combination bracket consisting of two J-brackets.

In the second attachment method, as shown in FIG. 13, the water-delivering tube 28 is supported by at least two combination brackets 128. Each of the brackets 128 consists of a first J-bracket 130 having a lower cradle 132 that includes a tube-securing bolt 126 and a reverse upper cradle 134. The lower cradle 132 is dimensioned to support the water-delivering tube 28 and the reverse cradle 134 is Placed over a cradle 136 that is located on a second J-bracket 138. The second J-bracket 138 includes a vertical section 140 that is permanently attached by an attachment means 124 such as bolts, to a side of the fire truck 160, as shown in FIG. 10, when the fire truck 152 is parked alongside a burning structure, the water-delivery tube 28 produces a water spray that can be directed into a selected area of the structure.

In the third attachment method, as shown in FIG. 10, the water-delivering tube 28 is fixedly attached, by an attachment means, to an upper structure of the fire truck 160.

While the invention has been described in complete detail and pictorially shown in the accompanying drawings it is not to be limited to such details, since many changes and modifications may be made in the invention without departing from the spirit and scope thereof. For example, the male and female couplers can be reversed and the elements used in the device can be made of a metal or plastic. Hence, it is described to cover any and all modifications and forms which may come within the language and scope of the appended claims.

What is claimed is:

1. A fire-extinguishing device comprising:

a) at least one water-spraying unit having a lower male coupler and an upper water-dispersing orifice, b) a water hose having a front female coupler and a rear water-source coupler, c) a water-delivering tube having:

(1) a closed front end, (2) a rear end having a male coupler dimensioned to be coupled to the front female coupler on said water hose, (3) a lower section, and (4) an upper section having at least one threaded port dimensioned to receive the lower male coupler of said water-spraying unit, wherein when said water hose is attached to said water-delivering tube and the rear water-source coupler on said hose is connected to a pressurized water source, said water-spraying unit produces a water spray that can be directed into a burning area.

2. The device as specified in claim 1 wherein said water-spraying unit is angled upward from 10° to 80° and has means for selectively directing the water spray over a 360° circular pattern.

3. The device as specified in claim 2 wherein the at least one threaded port is located substantially at the center of the upper section of said water-delivering tube.

4. The device as specified in claim 3 wherein said water-delivering tube is comprised of a triangular water-delivering tube having a rear section and a pointed front end that can function as a battering ram for penetrating a building structure.

5. The device as specified in claim 4 further comprising an outward-extending structure consisting of a pair of legs having rear ends, and front ends that are attached, by an attachment means, to the rear section of said triangular water-delivering tube, and the rear ends of the legs angularly terminate at a cylindrical opening that is in alignment with the male coupler extending from the rear end of said triangular water-delivering tube.

6. A fire-extinguishing device comprising:

a) at least one water-spraying unit having a lower male coupler and an upper water-dispersing orifice, b) a water hose having a front female coupler and a rear water-source coupler, c) a water-delivering tube having:

(1) a closed front end, (2) a rear end having a male coupler dimensioned to be coupled to the front female coupler on said water hose, (3) a lower section, and (4) an upper section having at least one threaded port dimensioned to receive the lower male coupler of said water-spraying unit, wherein when said water hose is attached to said water-delivering tube and the rear water-source coupler on said hose is connected to a pressurized water source, said water-spraying unit produces a water spray that can be directed into a burning area, wherein the at least one threaded port is located substantially at the center of the upper section of said water-delivering tube, wherein said water-delivering tube is comprised of a triangular water-delivering tube having a rear section and a pointed front end that can function as a battering ram for penetrating a building structure, the device further comprising an outward-extending structure consisting of a pair of legs having rear ends, and front ends that are attached, by an attachment means, to the rear section of said triangular water-delivering tube, and the rear ends of the legs angularly terminate at a cylindrical opening that is in alignment with the male coupler extending from the rear end of said triangular water-delivering tube, the device further comprising an elongated water supply tube having a front female coupler and a rearward hand-gripping section having a pair of lateral handles and that terminates in a male coupler that attaches to the front female coupler on said water hose, wherein said pole is dimensioned to slidably fit through the cylindrical opening and with the front female coupler attached to the male coupler on the rear section of said triangular water-delivering tube.

7. The device as specified in claim 6 further comprising an elongated water supply tube stabilizing platform having a lower surface and an upper grooved surface dimensioned to slidably support and stabilize said elongated tube, wherein said platform allows said elongated tube to travel along the grooved surface when said triangular water-delivering tube is moved forward into a burning building.

8. The device as specified in claim 6 further comprising an elongated water supply tube stabilizing platform having an upper grooved surface and a lower surface that includes a set of wheels, and means for securing said elongated tube to the upper grooved surface, wherein said platform allows the secured elongated tube to move said triangular water-delivering tube forward into a burning building.

9. The device as specified in claim 6 wherein said triangular water-delivering tube further comprises a protective shroud that is hinged to a side of said tube, wherein said shroud protects said water-spraying units when a battering is in progress.

10. A fire-extinguishing device comprising:

a) at least one water-spraying unit having a lower male coupler and an upper water-dispersing orifice, said water-spraying unit is angled upward from 10° to 80° and has means for selectively directing the water spray over a 360° circular pattern, b) a water hose having a front female coupler and a rear water-source coupler, c) a water-delivering tube having:

(1) a closed front end, (2) a rear end having a male coupler dimensioned to be coupled to the front female coupler on said water hose, (3) a lower section, and (4) an upper section having at least one threaded port dimensioned to receive the lower male coupler of said water-spraying unit, wherein when said water hose is attached to said water-delivering tube and the rear water-source coupler on said hose is connected to a pressurized water source, said water-spraying unit produces a water spray that can be directed into a burning area, wherein the at least one threaded port is located substantially at the center of the upper section of said water-delivering tube, wherein said water-delivering tube is elongated with the lower section having attached, by an attachment means, a support structure that is outwardly angled to substantially fit upon the apex of a gabled roof.

11. The device as specified in claim 10 wherein said outwardly-angled support structure is comprised of at least a pair of angled legs, wherein each said leg has an upper end and a lower end, and wherein the upper end is attached by, an attachment means, to the lower section of said water-delivering tube.

12. The device as specified in claim 11 further comprising a pair of longitudinal support rods having an upper surface to which is attached the lower end of each said leg.

13. The device as specified in claim 12 further comprising a coupling hose having a first end terminating in a female coupler, a second end terminating in a female coupler and a third female coupler extending from a third side of said coupling hose and that is connected to a pressurized water source, wherein said coupling hose allows two said water-delivering tubes to be connected in series.

14. The device as specified in claim 12 further comprising a coupling tube having a first end terminating in a female coupler, a second end terminating in a female coupler and a third female coupler extending from a side of said coupling tube and that is connected to a pressurized water source, wherein said coupling tube allows at least two said water-delivering tubes to be connected in series.

15. The device as specified in claim 2 wherein the at least one threaded port is located on the upper section of said water-delivering tube at a distance substantially midway between the top of said tube's upper section and the beginning of said tube's lower section.

16. A fire-extinguishing device comprising:

a) at least one water-spraying unit having a lower male coupler and an upper water-dispersing orifice, said water-spraying unit is angled upward from 10° to 80° and has means for selectively directing the water spray over a 360° circular pattern, b) a water hose having a front female coupler and a rear water-source coupler, c) a water-delivering tube having:

(1) a closed front end, (2) a rear end having a male coupler dimensioned to be coupled to the front female coupler on said water hose, (3) a lower section, and (4) an upper section having at least one threaded port dimensioned to receive the lower male coupler of said water-spraying unit, wherein when said water hose is attached to said water-delivering tube and the rear water-source coupler on said hose is connected to a pressurized water source, said water-spraying unit produces a water spray that can be directed into a burning area, wherein the at least one threaded port is located on the upper section of said water-delivering tube at a distance substantially midway between the top of said tube's upper section and the beginning of said tube's lower section wherein said water-delivering structure is comprised of an elongated tube that is cradled by at least two J-brackets, wherein each bracket has a tube securing bolt vertical section that is permanently attached by an attachment means, to a side of a fire truck, wherein when the fire truck is parked adjacent a burning structure, said water-delivering tube, when connected to a pressurized water source, produces a water spray that can be directed into a burning area of the structure.

17. The device as specified in claim 15 wherein said water-delivering tube is supported by at least two combination brackets, wherein each said combination bracket consists of a first J-bracket having a lower cradle that includes a tube securing bolt and a reverse upper cradle, wherein the lower cradle is dimensioned to support said water-delivering tube and the reverse upper cradle is placed over a cradle on a second J-bracket having an upper vertical section that is permanently attached, by an attachment means, to a side of the fire truck, wherein when the fire truck is parked alongside a burning structure, said water-delivering tube produces a water spray that can be directed into a burning area.

* * * * *